US008177093B1

(12) United States Patent
Paul

(10) Patent No.: US 8,177,093 B1
(45) Date of Patent: May 15, 2012

(54) METHOD AND APPARATUS FOR SUPPORTING FACEPLATES

(76) Inventor: John R. Paul, Bel Air, MD (US)

( * ) Notice: Subject to any disclaimer, the term of this patent is extended or adjusted under 35 U.S.C. 154(b) by 1225 days.

(21) Appl. No.: 11/681,189

(22) Filed: Mar. 2, 2007

(51) Int. Cl.
*B65D 1/34* (2006.01)

(52) U.S. Cl. ..... 220/571; 62/291; 137/15.01; 137/312

(58) Field of Classification Search ..... 62/291; 137/15.01, 312; 220/571
See application file for complete search history.

(56) References Cited

U.S. PATENT DOCUMENTS

| | | | | |
|---|---|---|---|---|
| 3,353,615 | A * | 11/1967 | Nekimken | 177/245 |
| 3,420,431 | A * | 1/1969 | Donovan | 229/407 |
| D226,771 | S | 4/1973 | Jacobs | |
| 4,396,121 | A | 8/1983 | Lemmon | |
| 4,549,727 | A | 10/1985 | Kozar | |
| 4,746,009 | A | 5/1988 | Liberman | |
| D315,460 | S | 3/1991 | Sorce, Jr. | |
| 5,117,971 | A | 6/1992 | Fisher | |
| D333,028 | S * | 2/1993 | Lux, Jr. | D34/38 |
| 5,707,450 | A | 1/1998 | Thompson | |
| 5,762,184 | A | 6/1998 | Greiner | |
| 6,745,704 | B2 * | 6/2004 | Carter et al. | 108/55.1 |
| 2003/0000041 | A1 | 1/2003 | Jones | |
| 2008/0017596 | A1 * | 1/2008 | Brock | 211/10 |

* cited by examiner

*Primary Examiner* — Anthony Stashick
*Assistant Examiner* — Elizabeth Volz
(74) *Attorney, Agent, or Firm* — Garcia-Zamor IP Law; Ruy M. Garcia-Zamor

(57) ABSTRACT

A paint tray and/or paint tray insert and method of manufacturing same.

14 Claims, 12 Drawing Sheets

FIG. 1
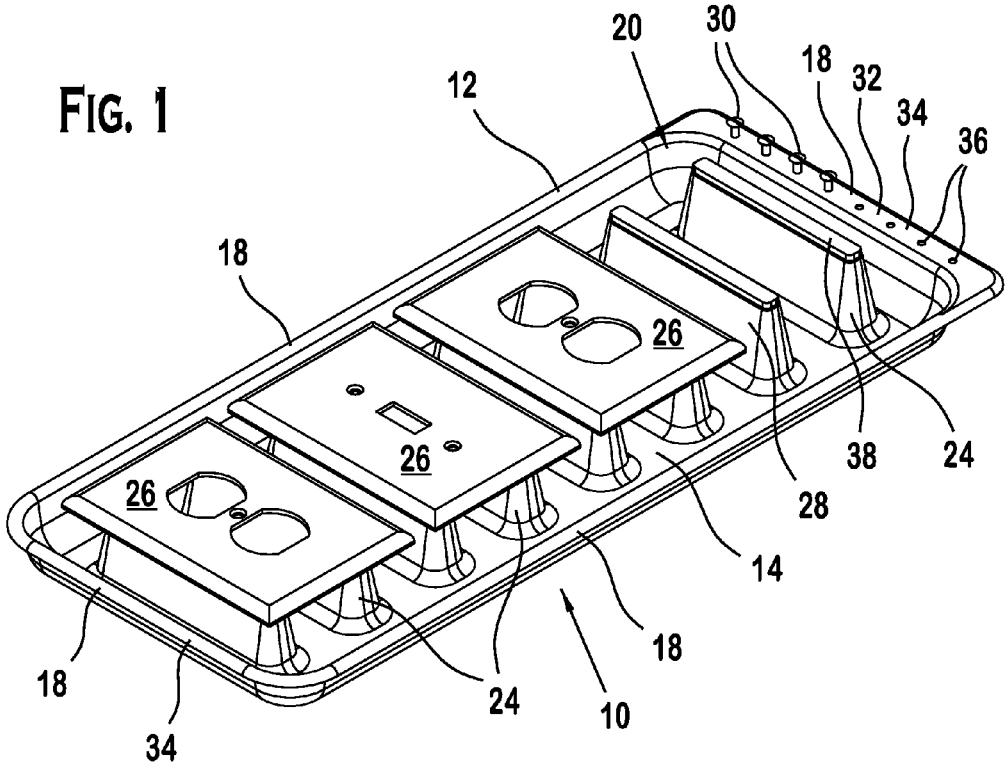
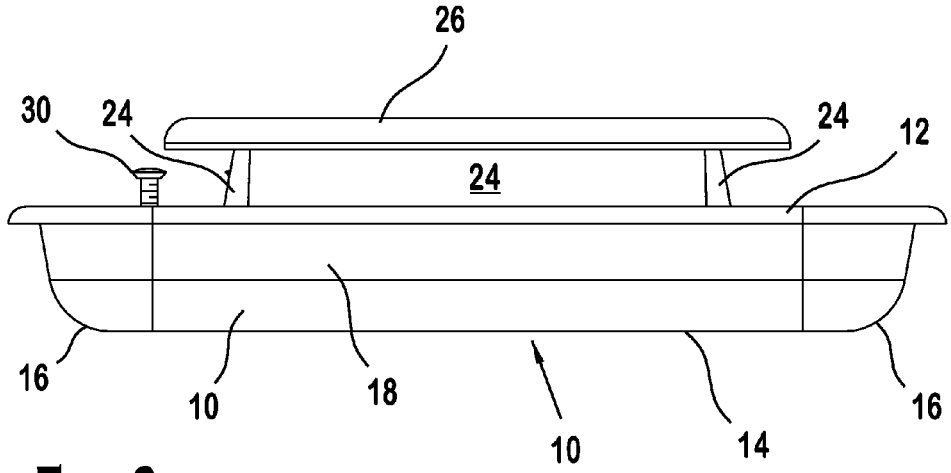
FIG. 2

METHOD AND APPARATUS FOR SUPPORTING FACEPLATES

BACKGROUND

The present invention relates generally to painting equipment and, more specifically, to methods and devices that facilitate the painting of faceplates.

Conventional paint trays allow for the easy placement of paint on rollers for use during painting. However, painting faceplates has and continues to be problematic. In some cases, faceplates are painted over during the painting of walls to simplify the painting process. Unfortunately, painting faceplates without removal from walls or the like often results in the paint getting within the associated electrical connection and dripping around the faceplate. Additionally, painted over faceplates are problematic when one wants to replace the faceplate and can lead to peeled away or chipped paint or torn drywall.

Instead of painting faceplates in place, some people hold them in one hand while painting them with a brush. This process is messy and somewhat cumbersome. As an alternative, some people lay faceplates on plastic tarps or newspaper for painting. Unfortunately, this method often results in the faceplates being adhered to the tarp or newspaper via dried paint. Furthermore, excess paint often pools along the edge of the faceplate and the associated tarp or newspaper which results in an unattractive bubble of paint being located on the painted faceplate.

It may be advantageous to provide a paint tray and/or a method of manufacturing the same that simplifies the painting of faceplates; which preferably allows faceplates to be painted without excess paint drying along the edges of the faceplates; which preferably positions the faceplate for simplified painting; and which can preferably be manufactured and used in an efficient manner.

SUMMARY

One embodiment of the present invention is directed to a method of manufacturing a paint tray. The method includes: providing a container comprising a base having a periphery with a sidewall extending upwardly along the periphery to define a well adapted to hold paint; and providing at least one faceplate support on the base configured to hold a faceplate thereon such that the faceplate can be painted with excess paint that drips from the faceplate being caught in the well.

In a separate aspect, one embodiment of the present invention is directed to a paint tray including a container. The container includes a base having a periphery with a sidewall extending generally upwardly along the periphery to define a well adapted to hold paint. At least one faceplate support is positioned on the base and has an upper surface spaced from the base such that the at least one faceplate support is adapted to hold a faceplate thereon to allow painting of the faceplate with excess paint that falls from the faceplate being captured in the well.

In a separate aspect, one embodiment of the present invention is directed to a paint tray including a container including a base having a periphery with a sidewall extending generally upwardly along the periphery to define a well adapted to hold paint. The sidewall is configured to form a lip that is generally parallel to at least a portion of the base of the paint tray. The lip defines a plurality of bores adapted to hold a faceplate screw to facilitate painting thereof. At least one faceplate support is positioned on the base and has an upper surface spaced from the base such that the at least one faceplate support is adapted to hold a faceplate thereon to allow painting of the faceplate with excess paint that falls from the faceplate being captured in the well.

In a separate aspect, one embodiment of the present invention is directed to a method of manufacturing a paint tray. The method includes: providing a container comprising a base having a periphery with a sidewall extending upwardly along the periphery to define a well adapted to hold paint; and providing at least one faceplate support located on the container and configured to hold a faceplate thereon such that the faceplate can be painted with excess paint that drips from the faceplate being caught in the well.

In a separate aspect, one embodiment of the present invention is directed to a method of manufacturing a paint tray accessory. The method includes: providing a frame configured for at least one of engagement with and insertion into a paint tray; and providing at least one faceplate support positioned on the frame and configured to hold a faceplate thereon in a generally horizontal orientation such that, when the frame is at least one of engaged with and inserted into a paint tray, the faceplate can be painted with excess paint that drips from the faceplate being caught in the paint tray.

BRIEF DESCRIPTION OF THE DRAWINGS

The foregoing summary, as well as the following detailed description of the preferred embodiments of the invention, will be better understood when read in conjunction with the appended drawings. For the purpose of illustrating the invention, there are shown in the drawings embodiments which are presently preferred. It is understood, however, that the invention is not limited to the precise arrangements and instrumentalities shown. In the drawings:

FIG. 1 is perspective view of a paint tray according to a first preferred embodiment of the present invention; The paint tray is shown with multiple types of faceplates thereon, each positioned on at least one faceplate support; The faceplate supports extend upwardly from a base of the paint tray; A sidewall extends upwardly from the periphery of the base to form a well adapted to hold paint; A portion of the sidewall is configured to form a lip which defines bores for holding faceplate screws to simplify the painting of screws during the process of painting the faceplates;

FIG. 2 is a left side elevational view of the paint tray of FIG. 1 illustrating the preferred curvature along the transition between the base and the sidewall of the paint tray; A polymer can be located on at least a portion of the faceplate supports to increase friction between the support and the faceplate to be painted to simplify painting;

DETAILED DESCRIPTION OF THE PREFERRED EMBODIMENTS

Figure 3:
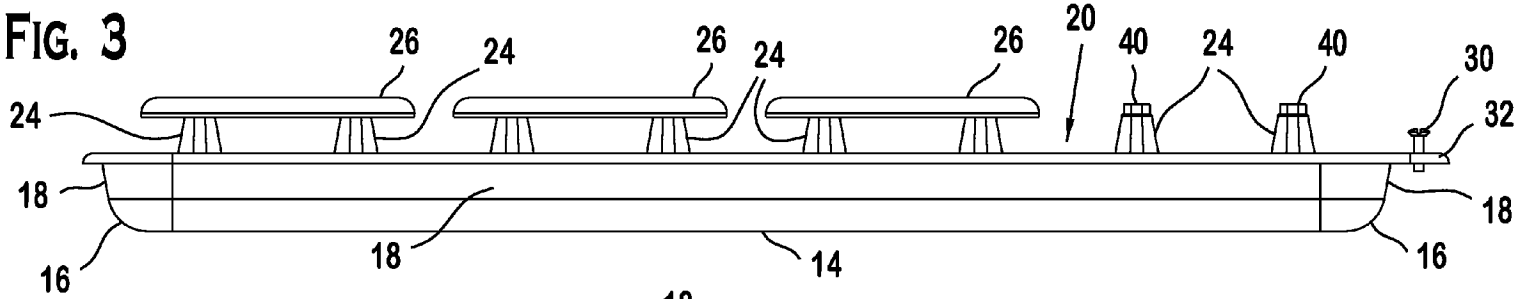
FIG. 3 is a front elevational view of the paint tray of FIG. 1 illustrating how each of the faceplates can be supported by multiple faceplate supports; While the faceplates are shown supported by two elongated supports, the faceplates can be supported by a single support, three supports, or any other number of supports; Additionally, the configuration of the supports can be circular, oval, cross shaped, X-shaped, irregular or the like without departing from the scope of the present invention; Magnetic material can be located on the faceplate supports to facilitate securing metallic faceplates in position during use.
Figure 4:
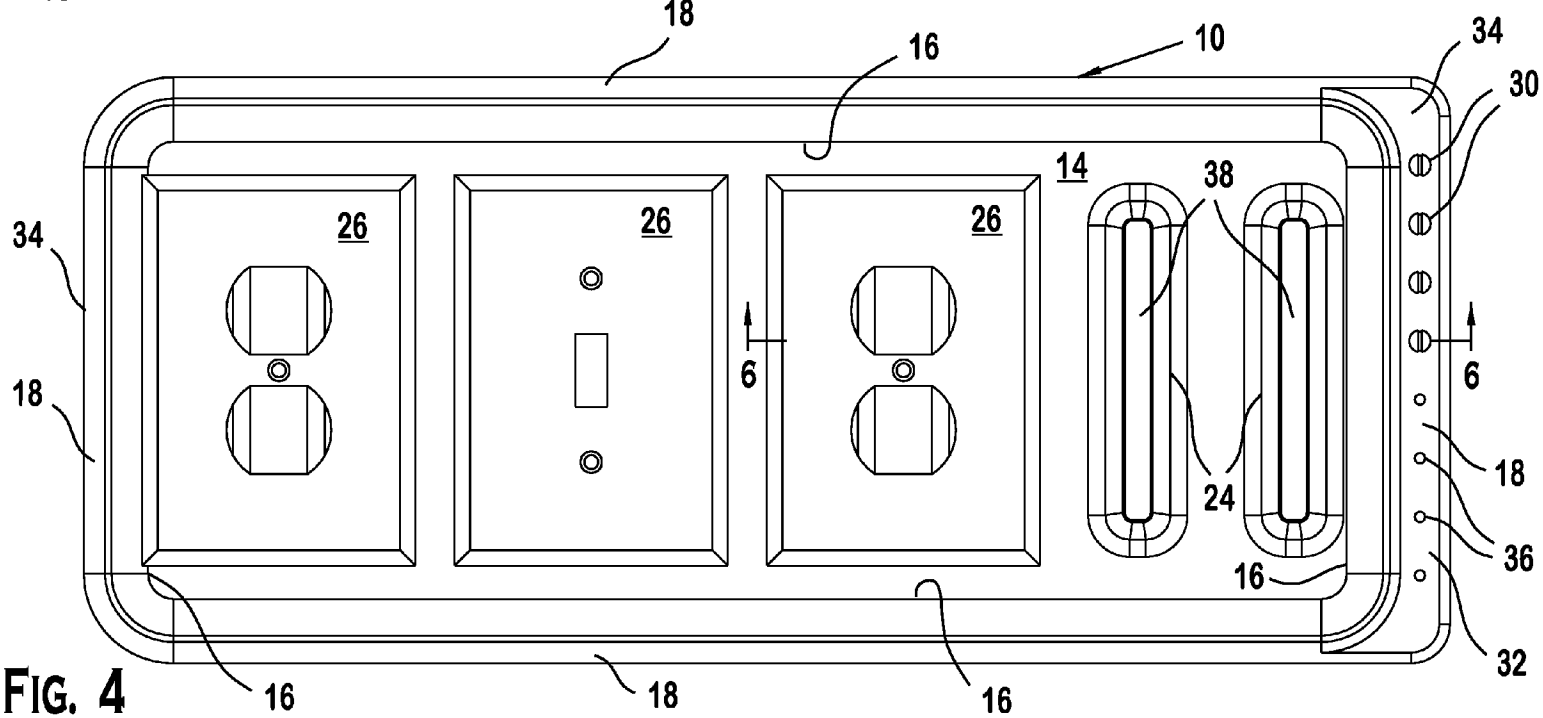
FIG. 4 is a top plan view of the paint tray of FIG. 1; While it is preferred that the paint tray have a generally rectilinear shape, any shape can be used without departing from the scope of the present invention.

Certain terminology is used in the following description for convenience only and is not limiting. The words "right," "left," "top," and "bottom" designate directions in the drawings to which reference is made. The words "inwardly" and "outwardly" refer to directions toward and away from, respectively, the geometric center of the paint tray and designated parts thereof. The term "faceplate", as used in the claims and corresponding portions of the specification, means "any faceplate, outlet cover, generally flat plate, panel, switch cover, cable connection cover, junction box cover, telephone jack cover, multi-gang electrical cover, or the like". The language "at least one of 'A', 'B', and 'C'," as used in the claims and in corresponding portions of the specification, means "any group having at least one 'A'; or any group having at least one 'B'; or any group having at least one 'C';—and does require that a group have at least one of each of 'A', 'B', and 'C'." Additionally, the words "a" and "one" are defined as including one or more of the referenced item unless specifically stated otherwise. The terminology includes the words above specifically mentioned, derivatives thereof, and words of similar import.

Referring to FIGS. 1-17, wherein like numerals indicate like elements throughout, preferred embodiments of a paint tray according to the present invention are shown and generally designated as 10. Briefly speaking the paint tray 10 facilitates the painting of faceplates 26 and is preferably usable as a stand alone paint tray, a reversible paint tray, and/or an insert for use with a larger conventional paint tray 46.

The paint tray 10 is preferably formed by a sturdy, non reactive, light weight material such as aluminum or a suitable polymer. However, any suitable material can be used without departing from the scope of the present invention. For example, the paint tray can be formed of polyethylene terephthalate (PET), polyvinyl chloride (PVC), polyphthalate carbonate (PPC), metallic material, composite, or the like.

Figure 12:
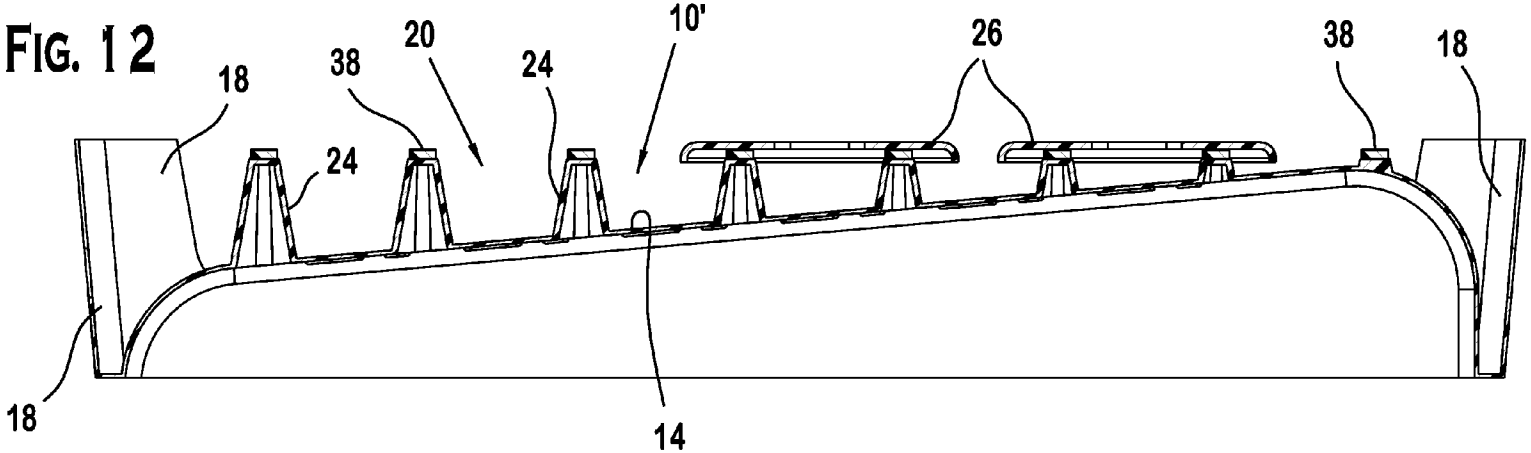
FIG. 12 is a cross-sectional view of the paint tray of FIG. 10 as taken along the line 12-12 of FIG. 10.

Referring to FIGS. 1-7, a first preferred method of manufacturing a paint tray 10 according to the present invention is as follows. A container 12 includes a base 14 which is preferably generally rectangular in shape. A sidewall 18 extends generally upwardly along the base periphery 16 to define a well 20 adapted to hold paint 22. Referring specifically to FIG. 2, the lower edges of the paint tray 10 are preferably, but not necessarily, rounded. While the paint tray 10 is shown as having a generally horizontally oriented base 14, those of ordinary skill in the art will appreciate that part of the base 14 can be inclined (as shown in FIG. 12) without departing from the scope of the present invention. Additionally, the paint tray 10 can have any overall shape, such as circular, oval, etc. without departing from the present invention.

Figure 5:
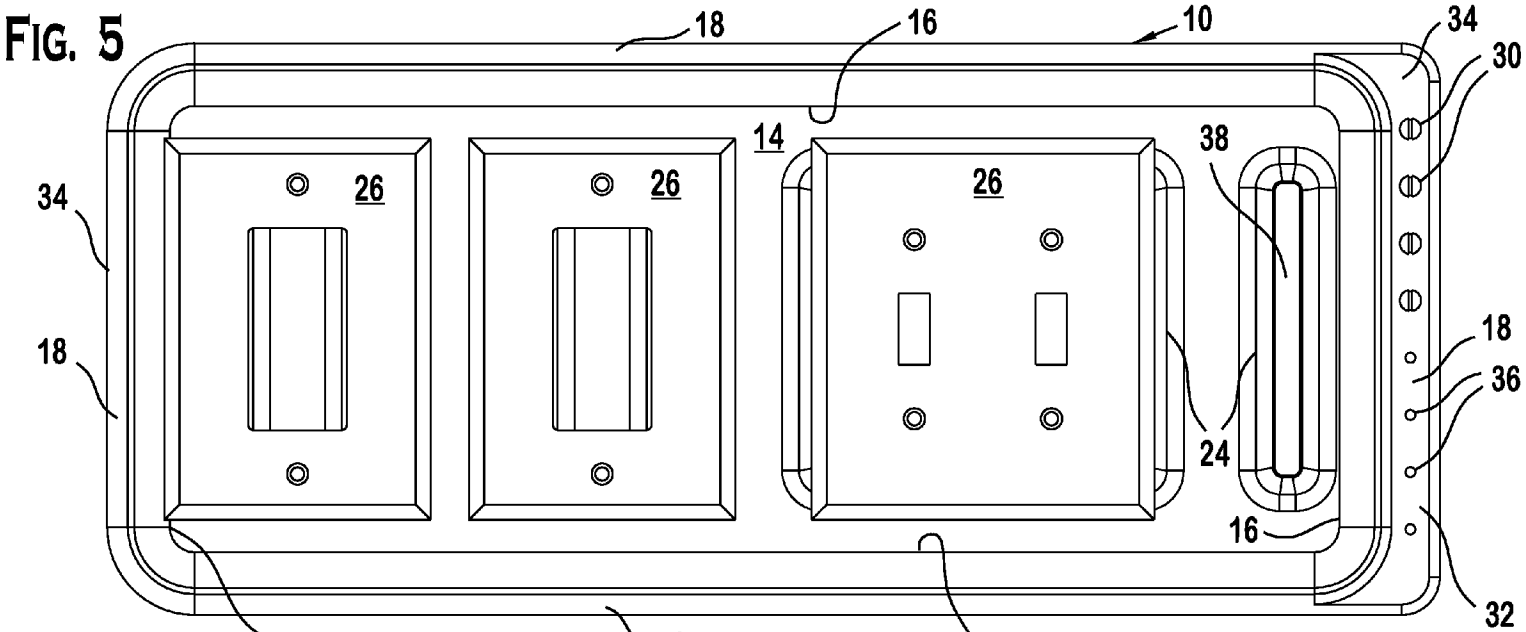
FIG. 5 is a top plan view of the paint tray of FIG. 1 supporting faceplates of a different configuration from that shown in FIGS. 1-4; Any size or configuration of faceplates can be used with the paint tray of the present invention.
Figure 6:
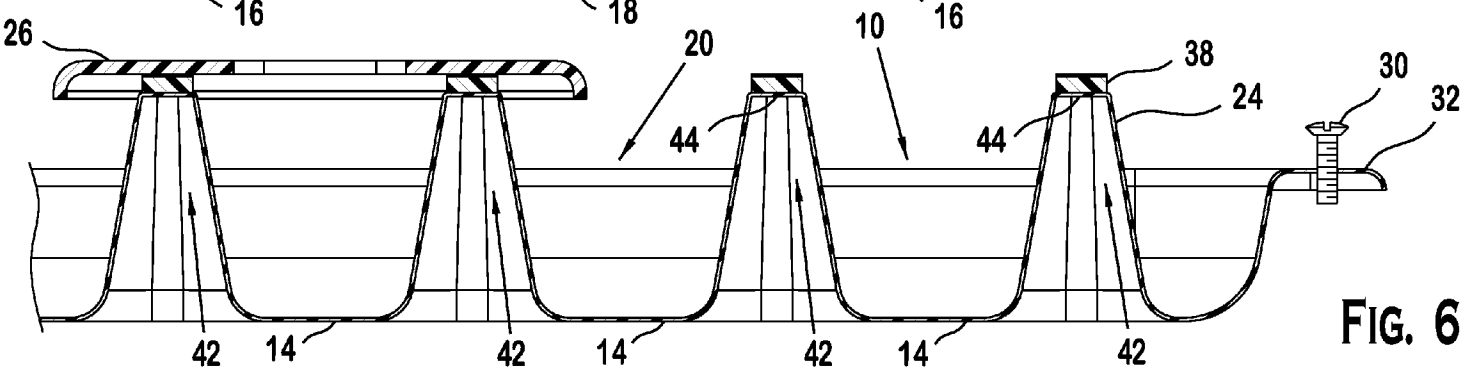
FIG. 6 is a cross-sectional view of the paint tray of FIG. 4 as taken along the line 6-6 of FIG. 4 illustrating how the faceplate supports may be configured with a hollow center for simplified stacking of multiple paint trays of the present invention; The faceplate supports are preferably configured to support the faceplate in a generally horizontal orientation.

As best shown in FIGS. 5 and 6, the method may include the sidewall 18 defining a plurality of bores 36 each configured to hold a faceplate screw 30 to facilitate painting thereof. It is preferred that the sidewall 18 is configured to provide an upside down U-shaped lip 32 which defines the bores 36. It is preferred that the bores 36 are configured to present the tops of the faceplate screws 30 in a generally upwardly direction from the paint tray 10 when located therein.

Figure 8:
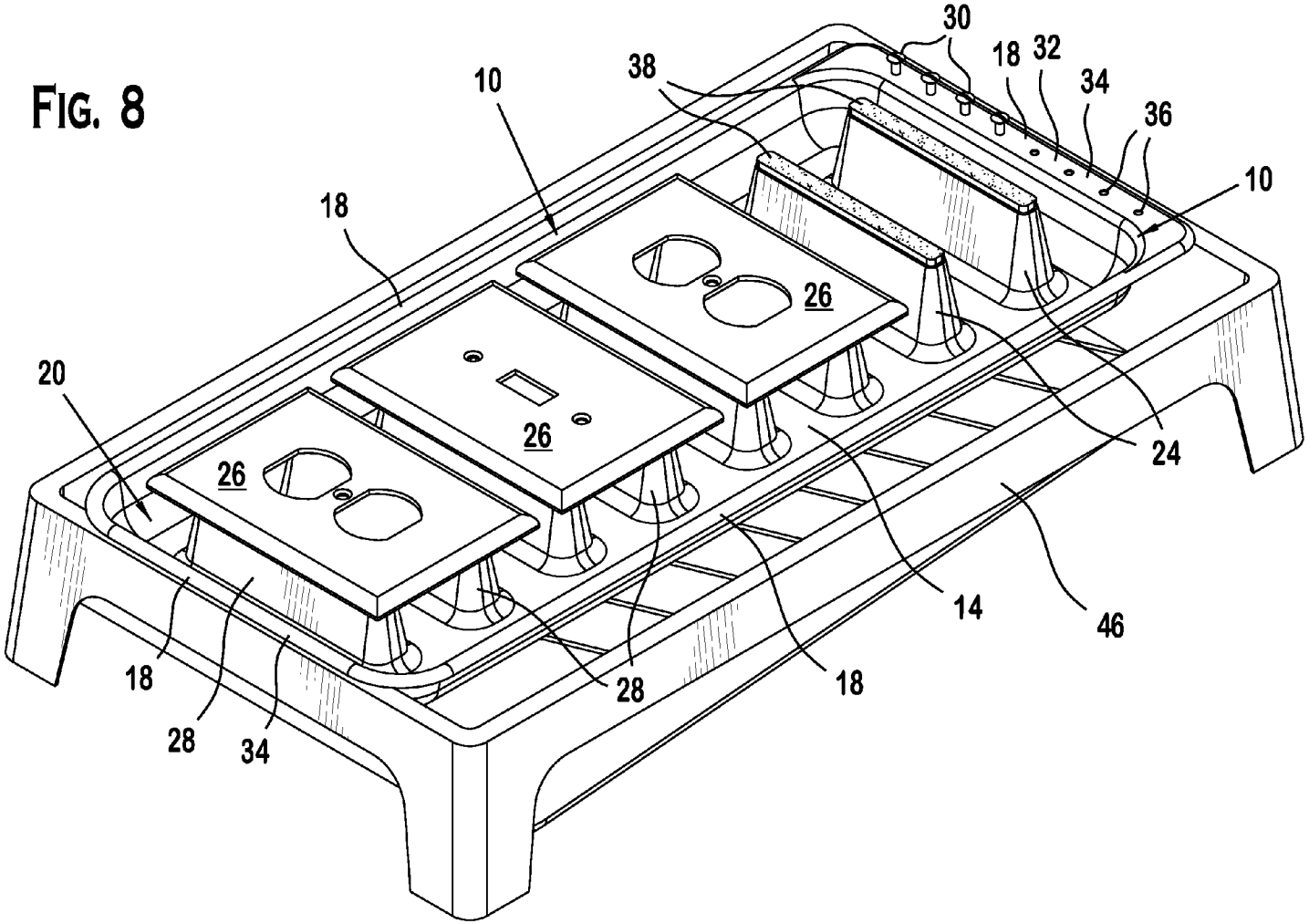
FIG. 8 is a perspective view of the paint tray of the present invention sized for use as an insert to allow a conventional paint tray to be retrofitted to simplify the painting of faceplates; While the paint tray of the present invention is shown as resting within a larger conventional paint tray and abutting the conventional paint tray with opposing edges, those of ordinary skill in the art will appreciate from this disclosure that any suitable connection method can be used without departing from the scope of the present invention.
Figures 9, 10:
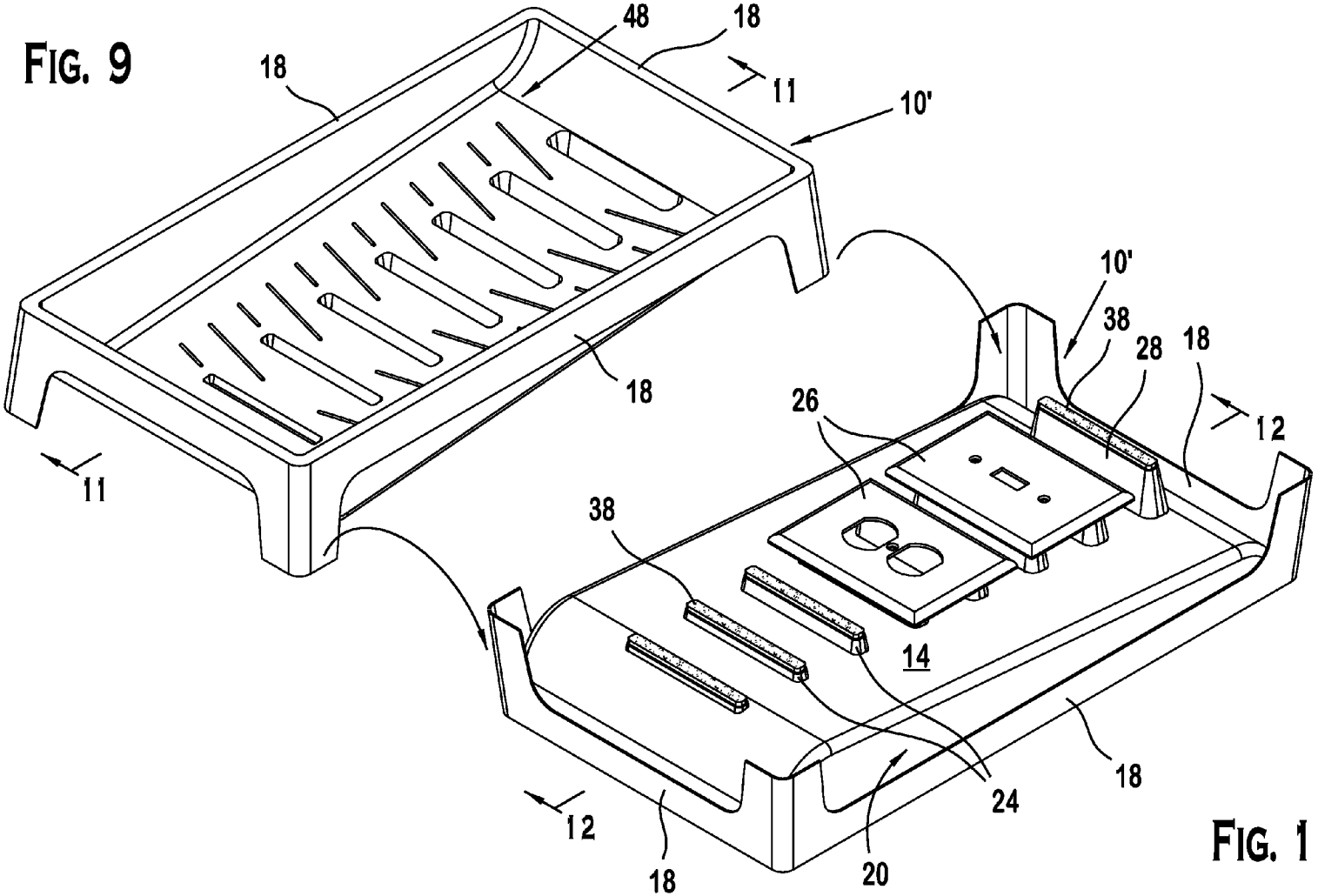
FIG. 9 is a perspective view of a paint tray according to a second preferred embodiment of the present invention; The paint tray is reversible with paint wells on both sides; Depending on use, a painter can orient the paint tray as desired; In this view, the paint tray is oriented for use with a roller or brush; Optionally, in the event the hollow interior of the faceplate supports is exposed, a polymer film can be located over the cavities to prevent paint from flowing therein.
FIG. 10 is a second perspective view of the paint tray of FIG. 8 showing the paint tray reversed for simplified painting of faceplates.
Figure 11:
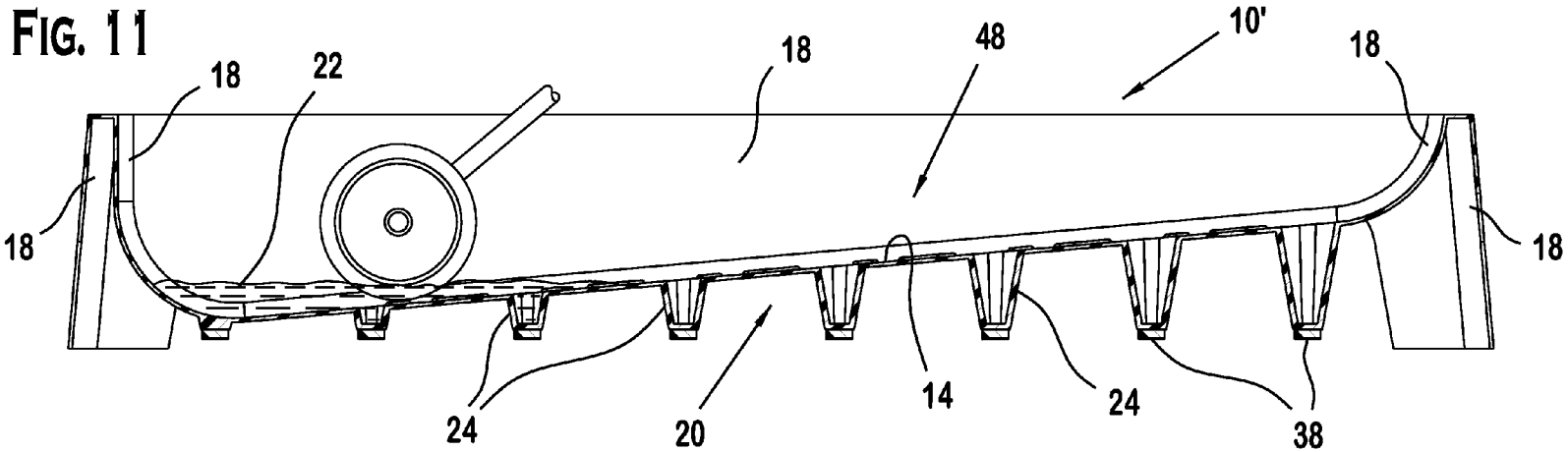
FIG. 11 is a cross-sectional view of the paint tray of FIG. 9 as taken along the line 11-11 of FIG. 9.

Referring to FIG. 8, the method of the present invention may include the container 12 having opposing edges 34 that are sized for at least partial insertion of the paint tray 10 inside of a larger, conventional paint tray 46. The container 12 may be supported generally within the larger, conventional paint tray 46 by positioning of the opposing edges 34 of the container 12 on a sidewall of the larger conventional paint tray 46. While one preferred connection method has been described, those of ordinary skill in the art will appreciate from this disclosure that the paint tray 10 can be sized to sit fully inside the well of the conventional paint tray 46 or can be affixed thereto using any suitable fastener, abutting relationship, or mechanical connection without departing from the scope of the present invention. One advantage of providing the paint tray 10 properly sized for use as an insert is that it can be used to retrofit and existing paint tray and then removed after use.

Figure 7:
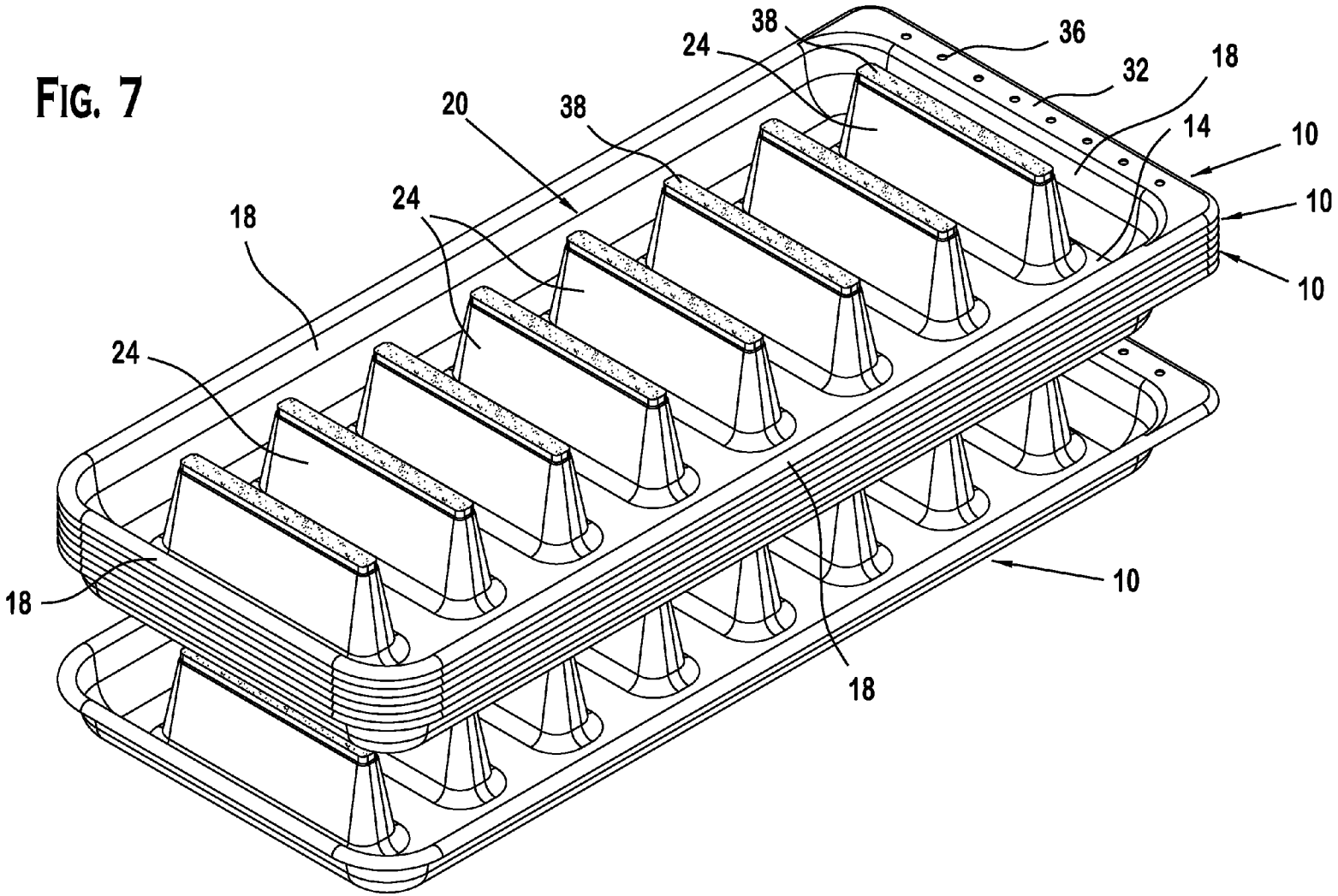
FIG. 7 is a perspective view of the paint tray of FIG. 1 illustrating the preferred stackable capacity of the paint trays when the faceplate supports have a hollow interior.
Figure 17:
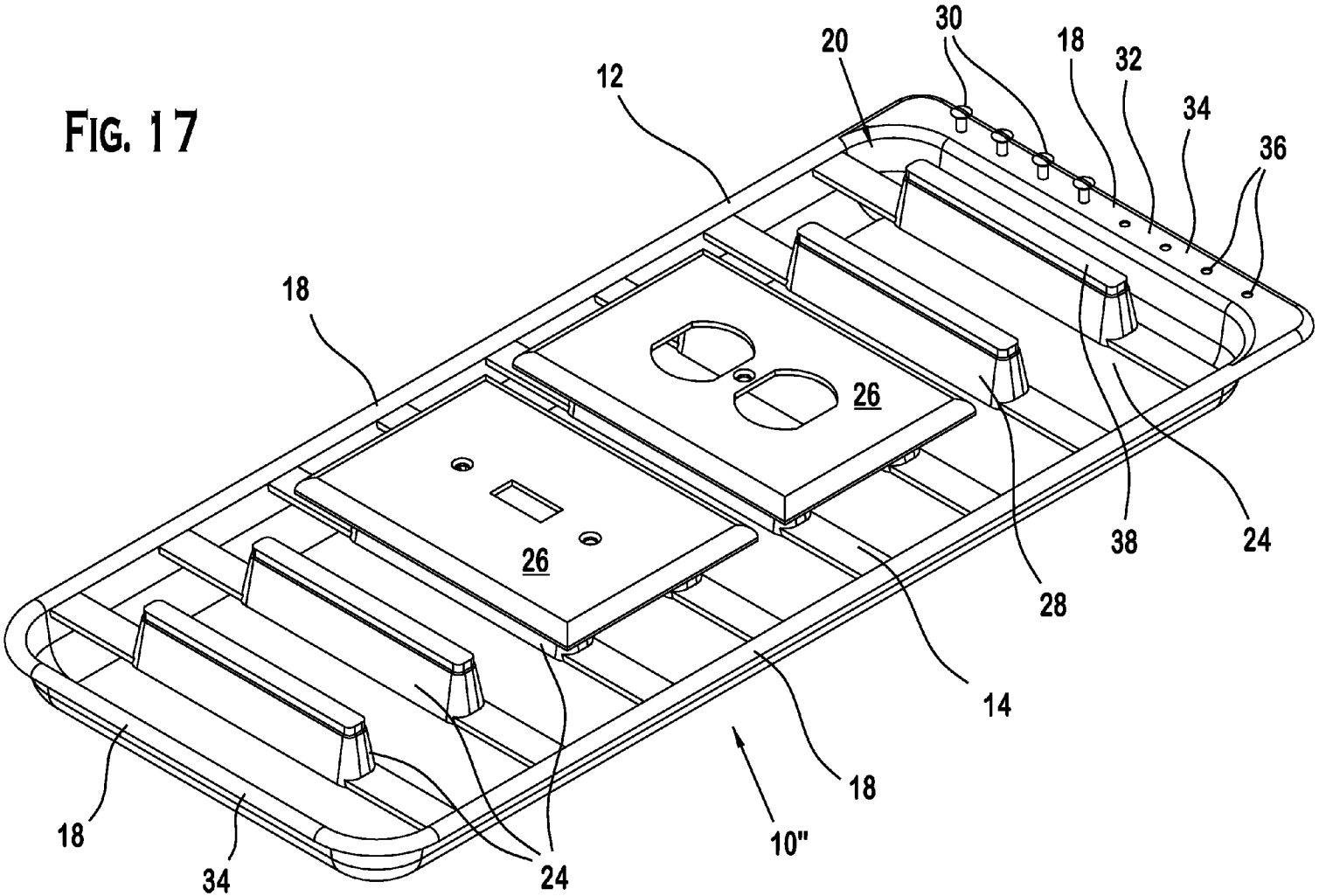
FIG. 17 is a perspective view of a paint tray according to a seventh preferred embodiment of the present invention illustrating faceplate supports that are positioned on the sidewall of the paint tray; The faceplate supports preferably support faceplates in a generally horizontal position and allow paint in the well (without obstruction by the at least one faceplate support) to flow along the paint tray base underneath the at least one faceplate; While a preferred configuration of the faceplate support is shown, any suitable faceplate support configuration can be used without deprting from the scope of the present invention.

Referring to FIGS. 1 and 17, the method of the present invention includes providing at least one faceplate support 24 which is positioned on the container 12 to hold a faceplate 26 such that the faceplate 26 can be painted with excess paint 22 that drips from the faceplate 26 being caught in the well 20 of the paint tray 10. Referring to FIGS. 5 and 7, the faceplate support 24 can be an elongated support that, on its own or in combination with another faceplate support 24, secures a faceplate 26 in a generally horizontal orientation to facilitate painting. Referring to FIGS. 5 and 6, the upper surface is preferrably adapted to support the faceplate, the faceplate support preferably being configured such that the circumferential edges of the faceplate do not contact the paint tray. Referring to FIGS. 6-8, it is preferably that the entire upper surface of the faceplate supporting surface is generally flat and configured to provide a generally planar surface without a protuberance thereon. The faceplate supports 24 can be configured to hold the faceplates 26 in another orientation without departing from the scope of the present invention.

Figure 13:
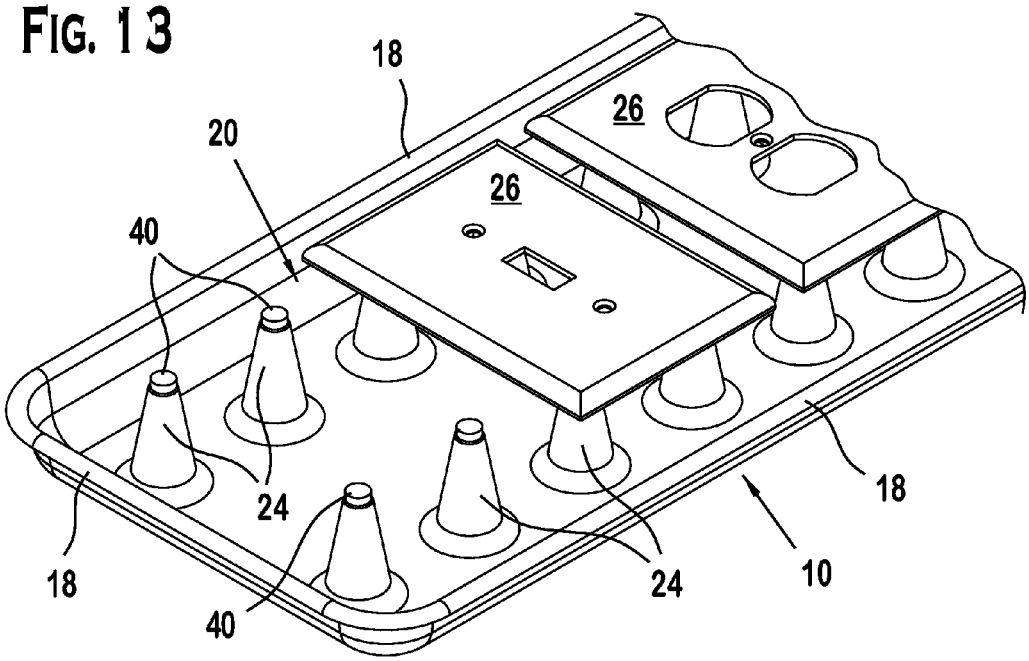
FIG. 13 is a broken away perspective view of a paint tray according to a third preferred embodiment of the present invention illustrating conical faceplates supports that preferably have a circular faceplate contacting surface; It is preferred, but not necessary, that four of the faceplate supports support each faceplate.
Figure 14:
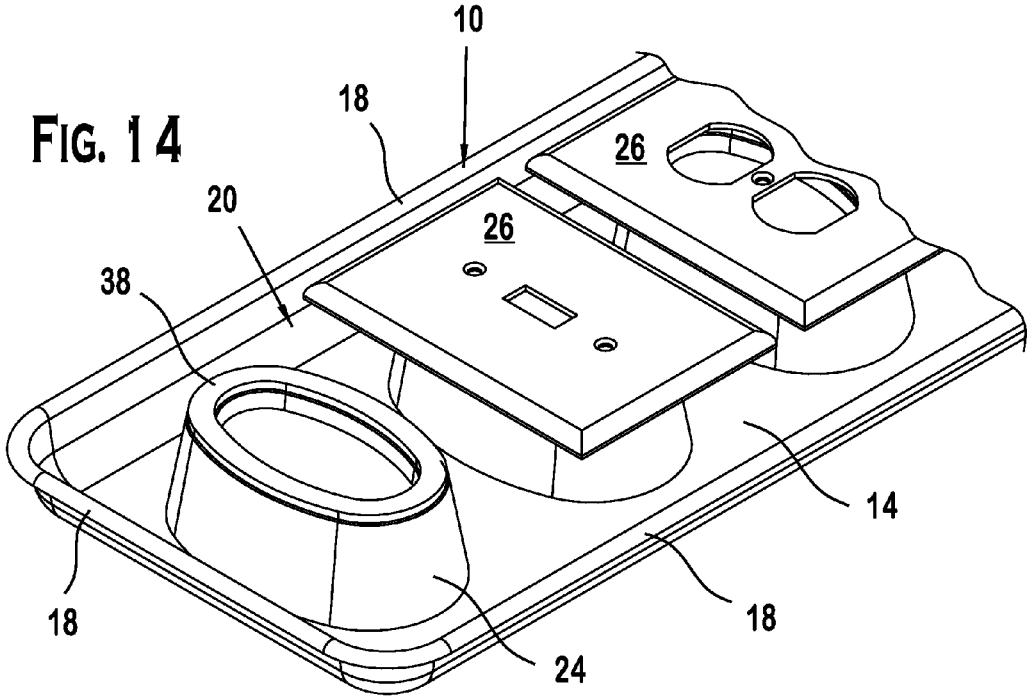
FIG. 14 is a broken away perspective view of a paint tray according to a fourth preferred embodiment of the present invention illustrating oval faceplate supports that preferably have an annular faceplate contacting surface; It is preferred, but not necessary, that one of the faceplate supports support each faceplate.
Figure 15:
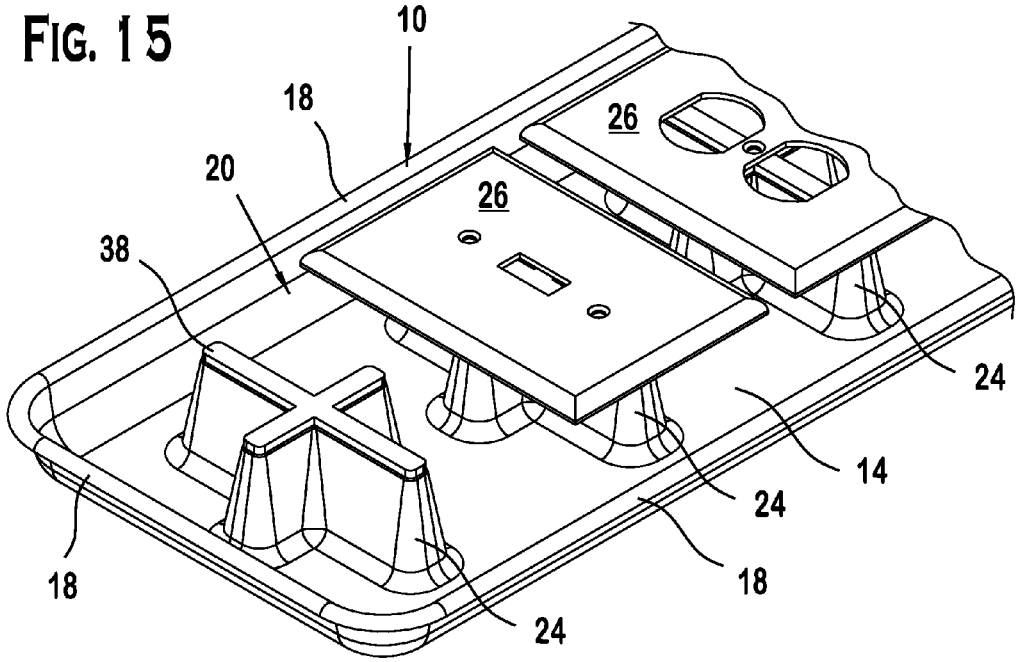
FIG. 15 is a broken away perspective view of a paint tray according to a fifth preferred embodiment of the present invention illustrating multi-armed faceplate supports that preferably have a cross-shaped faceplate contacting surface; It is preferred, but not necessary, that one of the faceplate supports support each faceplate.
Figure 16:
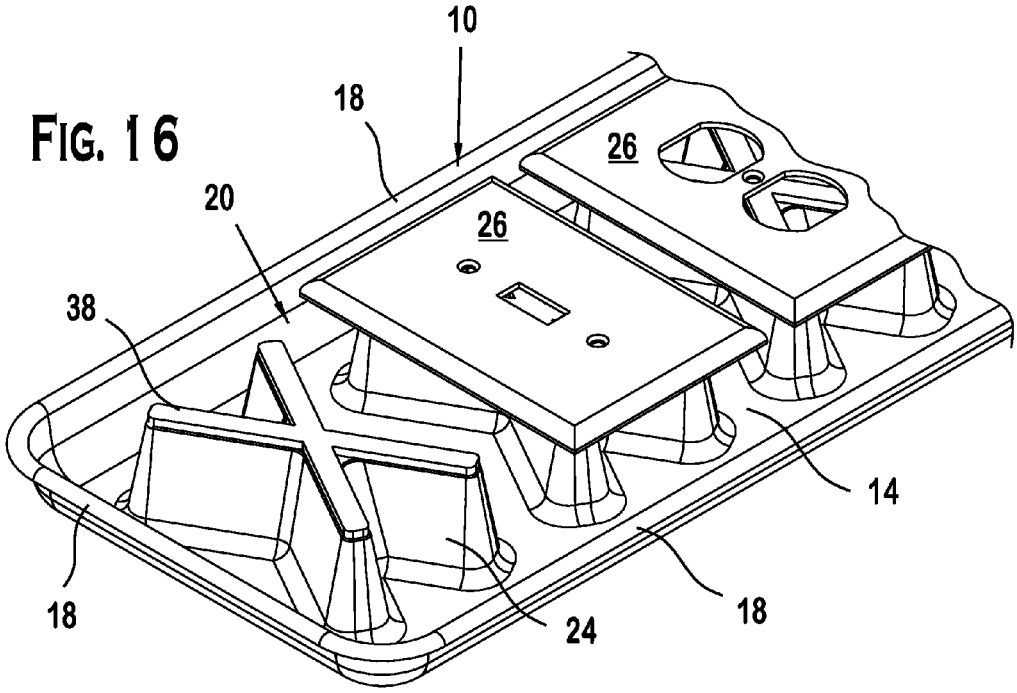
FIG. 16 is a broken away perspective view of a paint tray according to a sixth preferred embodiment of the present invention illustrating multi-armed faceplate supports that preferably have an X-shaped faceplate contacting surface; It is preferred, but not necessary, that one of the faceplate supports support each faceplate; As illustrated by FIGS. 7 and 13-16, the faceplate supports can have any suitable size, shape, or configuration without departing from the scope of the present invention.

The faceplate supports 24 can be of any desired shape or configuration and can be configured to support a faceplate 26 alone or in combination with other faceplate supports 24. Referring to FIG. 13, the faceplate supports may be conical with a circular faceplate contacting surface. It is preferred, but not necessary, that four of the faceplate supports support each faceplate. Referring to FIG. 14, the faceplate supports 24 may be oval shaped and have a generally annular faceplate contacting surface. The faceplate supports can be sized and positioned to support a faceplate 26 without use of a second support, if desired. FIG. 15 illustrates a multi-armed faceplate support 24 that preferably has a cross-shaped faceplate contacting surface. FIG. 16 illustrates multi-armed faceplate supports 24 that preferably have an X-shaped faceplate contacting surface. Those of ordinary skill in the art will appreciate from this disclosure that the faceplate supports 24 can have any suitable size, shape, or configuration without departing from the scope of the present invention.

Referring to FIG. 17, the method of the present invention may include providing faceplate supports 24 that are positioned on the sidewall 18 of the paint tray 10". It is preferable that the faceplate supports 24 support faceplates 26 in a generally horizontal orientation and allow paint 22 in the well 20 (without obstruction by the faceplate support 24) to flow along the paint tray base 14 underneath the at least one faceplate 26. While a preferred configurations of the faceplate support 24 are shown, any suitable faceplate support configuration or combination thereof can be used without departing from the scope of the present invention.

Referring to FIG. 1, the method of the present invention may include providing faceplate supports 24 that are located on the base 14 and are preferably configured to hold the faceplate 26 in a generally horizontal orientation. Faceplate supports can be positioned on both the base 14 and sidewall 18 without departing from the scope of the present invention.

Referring to FIG. 7, the faceplate supports 24 may be configured to provide two or more elongated supports 28 configured to support a faceplate 26 thereon. The faceplate supports 24 may be equidistantly spaced across the entire length (measured generally left to right in FIG. 7) of the paint tray 10 to allow more than one faceplate to be supported simultaneously. Alternatively, a portion of the well can be unobstructed by faceplate supports 24 to allow a user to both paint a faceplate 26 and then, use the remaining portion of the paint tray 10 in a conventional fashion. Additionally, the paint trays 10 can be stacked which can also be facilitated by forming the faceplate supports with a hollow interior 42 (as shown in FIG. 6).

Referring to FIG. 6, the method of the present invention may include locating a polymer 38 along at least a portion of an upper surface 44 of the faceplate support 24 to provide additional resistance between the faceplate 26 and the faceplate support 24 to reduce the instances of dislodgement of the faceplate 26 from the at least one faceplate support 24 during painting of the faceplate 26. Alternatively, referring to FIG. 3, magnetic material 40 can be positioned proximate to an upper surface of a faceplate support 24 to help secure a metallic faceplate 24 thereto.

Referring to FIGS. 9-12, the method of the present invention may include a portion of the sidewall 18 being configured to create a second well 48 on an opposite side of the base 14 from the faceplate supports 24 to create a reversible paint tray 10'. While the faceplate supports 24 are shown as being hollow and as opening to the second well 48, the faceplate supports 24 may be solid or sealed from the second well 48 without departing from the scope of the present invention. Alternatively, the method of the present invention may include placing a film layer on the base 14 in the second well 48 to prevent paint from entering in to the hollow interior of the faceplate supports.

Figure 18:
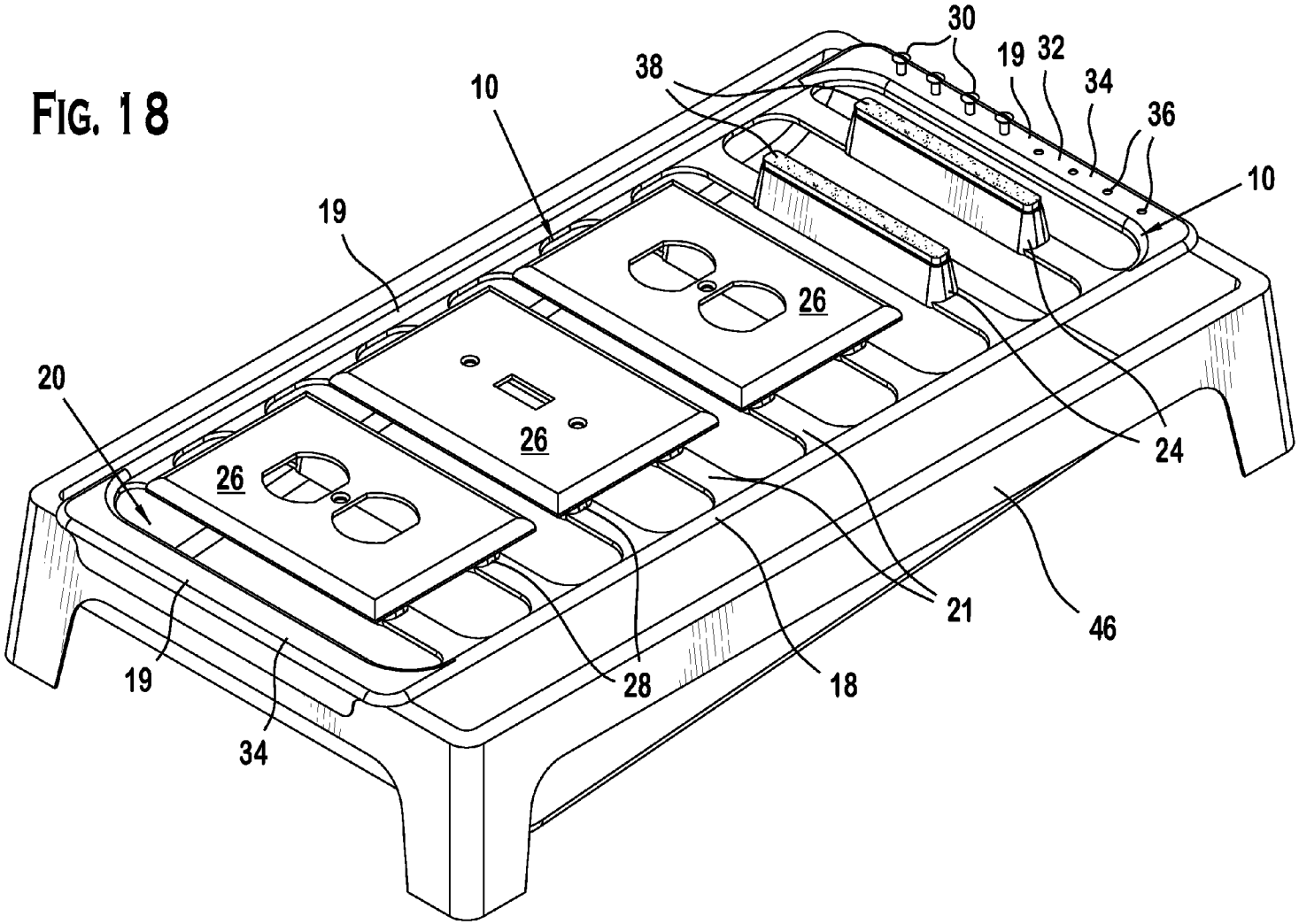
FIG. 18 is a perspective view of a paint tray according to an eighth preferred embodiment of the present invention which is configured for use as a retrofit for a conventional paint tray; The paint tray is shown as resting with opposing edges on the conventional paint tray; This paint tray does not have a base and is not configured to hold paint; Instead, this tray is formed by a frame to which the faceplate supports are attached, possibly by connectors; This tray allows a paint tray to be retrofit for painting of faceplates and, after the faceplates have cured, the insert can be removed and the conventional paint tray used in the normal fashion; The paint tray insert can be fastened to, positioned on, or rest within the conventional paint tray without departing from the scope of the present invention.
Figure 19:
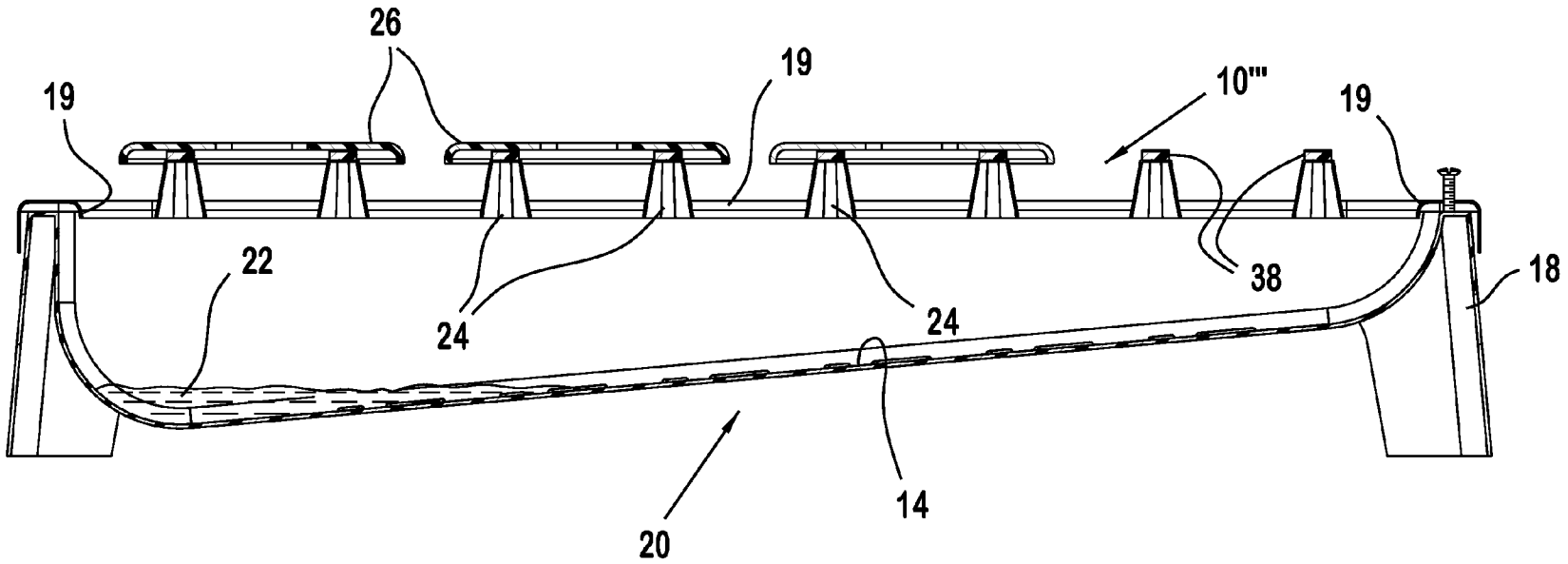
FIG. 19 is a cross-sectional view of the paint tray of FIG. 18 illustrating one possible engagement between the paint tray insert and the conventional paint tray.

Referring to FIGS. 18 and 19, one preferred method of manufacturing a paint tray accessory 10 includes providing a frame 19 configured for at least one of engagement with and insertion into a paint tray 46. At least one faceplate support 24 is preferably positioned on the frame 19 and configured to hold a faceplate 26 thereon in a generally horizontal orientation for painting. The faceplate support 24 may include connectors 21 that are used to position the faceplate contacting portion of the faceplate support 24 centrally in the paint tray 46. It is preferred, but not necessary, that the faceplate support 24 is located generally within an area bounded by the frame 19 such that and excess paint 22 that drips from the faceplate falls through the frame 19 and into the paint tray 46. Regardless, it is preferred that when the frame 19 is at least one of engaged with and inserted into the paint tray 46, the faceplate 26 can be painted with excess paint 22 that drips from the faceplate 26 being caught in the paint tray 46.

Referring specifically to FIG. 19, the frame 19 has left and right ends that hook over the paint tray sidewall to secure the frame 19 during painting of faceplates 26. This greatly simplifies the convenience and speed with which faceplates 26 can be painted.

Referring to FIGS. 1-6, one embodiment of the paint tray 10 operates as follows. A user positions the paint tray 10 on a supporting surface, such as a floor or larger paint tray. Then one or more faceplates 26 can be positioned on faceplate supports 24 positioned on the paint tray 10. Afterwards, the faceplate(s) 26 can be painted with preferably any excess paint dripping from the faceplates 26 being caught in the well 20 of the paint tray 10. Preferably, but not necessarily, the configuration of the faceplate supports 24 also prevents adhesion of the faceplate 26 to the paint tray 10 during curing of the painted faceplates 26.

While various shapes, configurations, and features have been described above and shown in the drawings for the various embodiments of the present invention, those of ordinary skill in the art will appreciate from this disclosure that any combination of the above features can be used without departing from the scope of the present invention. For example, the paint tray can be reversible, can have any configuration, any number of faceplate supports, and/or have combination of different types of faceplate supports on a single paint tray. It is understood, therefore, that this invention is not limited to the particular embodiments disclosed, but is intended to cover all modifications which are within the spirit and scope of the invention as defined by the appended claims and/or shown in the attached drawings.

What is claimed is:

1. A method of manufacturing a paint tray, comprising:

providing a container comprising a base having a periphery with a sidewall extending upwardly along the periphery to define a well adapted to hold paint; and providing at least one faceplate support on the base configured to hold a faceplate thereon such that the faceplate can be painted with excess paint that drips from the faceplate being caught in the well, wherein an entire upper surface of the faceplate support is generally flat and configured to provide a generally planar surface without a protuberance thereon, the upper surface being adapted to support the faceplate, the faceplate support being configured such that the circumferential edges of the faceplate do not contact the paint tray, the at least one faceplate support extending from the base a greater distance than the sidewall such that the upper surface of the at least one faceplate support is located above the sidewall, relative to the base, to prevent paint on the faceplate from simultaneously contacting the sidewall while still on the faceplate and to allow paint that drips to fall into the well, thereby encouraging paint on the faceplate to be generally smooth with reduced paint accumulations along edges thereof; and locating a polymer along at least a portion of the upper surface of the at least one faceplate support to provide additional resistance between the faceplate and the at least one faceplate support to reduce the instances of dislodgement of the faceplate from the at least one faceplate support during painting of the faceplate.

2. The method of claim 1, wherein the step of providing the at least one faceplate support further comprises a plurality of faceplate supports being equidistantly spaced across the entire length of the paint tray to allow more than one faceplate to be supported simultaneously.

3. The method of claim 1, wherein the step of providing the container includes the sidewall including a plurality of bores each configured to hold a faceplate screw to facilitate painting thereof.

4. The method of claim 3, wherein the step of providing the container further comprises the sidewall forming a lip that is generally parallel to at least a portion of the base of the paint tray, the plurality of bores being defined by the lip such that a top of the faceplate screw is oriented generally upwardly from the paint tray when located therein.

5. The method of claim 1, wherein the step of providing at least one faceplate support comprises providing at least two elongated supports configured to support the faceplate thereon.

6. The method of claim 5, wherein the step of providing the at least two elongated supports further comprises the at least two elongated supports being equidistantly spaced across the entire length of the paint tray to allow more than one faceplate to be supported simultaneously.

7. A method of manufacturing a paint tray, comprising:

providing a container comprising a base having a periphery with a sidewall extending upwardly along the periphery to define a well adapted to hold paint; and providing at least one faceplate support on the base configured to hold a faceplate thereon such that the faceplate can be painted with excess paint that drips from the faceplate being caught in the well, wherein an entire upper surface of the faceplate support is generally flat and configured to provide a generally planar surface without a protuberance thereon, the upper surface being adapted to support the faceplate, the faceplate support being configured such that the circumferential edges of the faceplate do not contact the paint tray, the at least one faceplate support extending from the base a greater distance than the sidewall such that the upper surface of the at least one faceplate support is located above the sidewall, relative to the base, to prevent paint on the faceplate from simultaneously contacting the sidewall while still on the faceplate and to allow paint that drips to fall into the well, thereby encouraging paint on the faceplate to be generally smooth with reduced paint accumulations along edges thereof, wherein the step of providing at least one faceplate support further comprises providing at least two elongated supports configured to support the faceplate thereon and forming the at least two elongated supports such that each has a hollow interior and such that the at least two elongated supports are integral with the base to allow the paint tray to be stacked with a second, identical paint tray with the at least two elongated supports of the paint tray positioned at least partially inside at least two elongated supports of the second, identical paint tray.

8. The method of 7, wherein the step of providing the container further comprises the container having opposing edges and being sized for at least partial insertion inside of a larger, conventional paint tray such that the container is supported generally within the larger, conventional paint tray by the positioning of the opposing sides of the container on a sidewall of the larger, conventional paint tray.

9. A method of manufacturing a paint tray, comprising:

providing a container comprising a base having a periphery with a sidewall extending upwardly along the periphery to define a well adapted to hold paint; and providing at least one faceplate support on the base configured to hold a faceplate thereon such that the faceplate can be painted with excess paint that drips from the faceplate being caught in the well, wherein an entire upper surface of the faceplate support is generally flat and configured to provide a generally planar surface without a protuberance thereon, the upper surface being adapted to support the faceplate, the faceplate support being configured such that the circumferential edges of the faceplate do not contact the paint tray, the at least one faceplate support extending from the base a greater distance than the sidewall such that the upper surface of the at least one faceplate support is located above the sidewall, relative to the base, to prevent paint on the faceplate from simultaneously contacting the sidewall while still on the faceplate and to allow paint that drips to fall into the well, thereby encouraging paint on the faceplate to be generally smooth with reduced paint accumulations along edges thereof, wherein the step of providing at least one faceplate support comprises providing at least two elongated supports configured to support the faceplate thereon, the at least two elongated supports being equidistantly spaced across the entire length of the paint tray to allow more than one faceplate to be supported simultaneously; and positioning a magnetic material proximate to an upper surface of the at least two elongated supports to help secure a metallic faceplate thereto.

10. A method of manufacturing a paint tray, comprising:

providing a container comprising a base having a periphery with a sidewall extending upwardly along the periphery to define a well adapted to hold paint;

providing at least one faceplate support on the base configured to hold a faceplate thereon such that the faceplate can be painted with excess paint that drips from the faceplate being caught in the well, wherein an entire upper surface of the faceplate support is generally flat and configured to provide a generally planar surface without a protuberance thereon, the upper surface being adapted to support the faceplate, the faceplate support being configured such that the circumferential edges of the faceplate do not contact the paint tray, the at least one faceplate support extending from the base a greater distance than the sidewall such that the upper surface of the at least one faceplate support is located above the sidewall, relative to the base, to prevent paint on the faceplate from simultaneously contacting the sidewall while still on the faceplate and to allow paint that drips to fall into the well, thereby encouraging paint on the faceplate to be generally smooth with reduced paint accumulations along edges thereof; and positioning a magnetic material proximate to an upper surface of the at least one faceplate support to help secure a metallic faceplate thereto.

11. A method of manufacturing a paint tray, comprising:

providing a container comprising a base having a periphery with a sidewall extending upwardly along the periphery to define a well adapted to hold paint; and providing at least one faceplate support positioned on the container and configured to hold a faceplate thereon such that the faceplate can be painted with excess paint that drips from the faceplate being caught in the well, wherein an entire upper surface of the faceplate support is generally flat and configured to provide a generally planar surface without a protuberance thereon, the upper surface being adapted to support the faceplate, the faceplate support being configured such that the circumferential edges of the faceplate do not contact the paint tray, the at least one faceplate support extending from the base a greater distance than the sidewall such that the upper surface of the at least one faceplate support is located above the sidewall, relative to the base, to prevent paint on the faceplate from simultaneously contacting the sidewall while still on the faceplate and to allow paint that drips to fall into the well, thereby encouraging paint on the faceplate to be generally smooth with reduced paint accumulations along edges thereof, wherein the step of providing the at least one faceplate support includes the at least one faceplate support being located on the sidewall, wherein paint in the well is not obstructed by the at least one faceplate support from flowing along the base underneath the at least one faceplate.

12. A method of manufacturing a paint tray, comprising:

providing a container comprising a base having a periphery with a sidewall extending upwardly along the periphery to define a well adapted to hold paint; and providing at least one faceplate support positioned on the container and configured to hold a faceplate thereon such that the faceplate can be painted with excess paint that drips from the faceplate being caught in the well, wherein an entire upper surface of the faceplate support is generally flat and configured to provide a generally planar surface without a protuberance thereon, the upper surface being adapted to support the faceplate, the faceplate support being configured such that the circumferential edges of the faceplate do not contact the paint tray, the at least one faceplate support extending from the base a greater distance than the sidewall such that the upper surface of the at least one faceplate support is located above the sidewall, relative to the base, to prevent paint on the faceplate from simultaneously contacting the sidewall while still on the faceplate and to allow paint that drips to fall into the well, thereby encouraging paint on the faceplate to be generally smooth with reduced paint accumulations along edges thereof, wherein the step of providing the at least one faceplate support includes the at least one faceplate support being positioned on the sidewall and configured to support the at least one faceplate in a generally horizontal orientation, wherein paint in the well is not obstructed by the at least one faceplate support from flowing along the base underneath the at least one faceplate.

13. A method of manufacturing a paint tray, comprising:

providing a container comprising a base having a periphery with a sidewall extending upwardly along the periphery to define a well adapted to hold paint, the sidewall including a plurality of bores each configured to hold a faceplate screw to facilitate painting thereof, providing at least one faceplate support on the base configured to hold a faceplate thereon such that the faceplate can be painted with excess paint that drips from the faceplate being caught in the well; and locating a polymer along at least a portion of an upper surface of the at least one faceplate support to provide additional resistance between the faceplate and the at least one faceplate support to reduce the instances of dislodgement of the faceplate from the at least one faceplate support during painting of the faceplate.

14. The method of claim 13 wherein the step of providing a container further comprises the sidewall forming a lip that is generally parallel to at least a portion of the base of the paint tray, the plurality of bores being defined by the lip such that a top of the faceplate screw is oriented generally upwardly from the paint tray when located therein;

* * * * *